United States Patent [19]

Doty et al.

[11] Patent Number: 4,562,625

[45] Date of Patent: Jan. 7, 1986

[54] SEAT BELT BUCKLE

[75] Inventors: Gerald A. Doty, Crown Point; William E. Hunter, Jr., Highland, both of Ind.

[73] Assignee: Gateway Industries, Inc., Hazel Crest, Ill.

[21] Appl. No.: 564,239

[22] Filed: Dec. 21, 1983

[51] Int. Cl.[4] ..... A44B 11/28

[52] U.S. Cl. ..... 24/640; 24/641; 24/643; 24/645

[58] Field of Search ..... 24/630–645, 24/650

[56] References Cited

U.S. PATENT DOCUMENTS

| | | | |
|---|---|---|---|
| 3,238,587 | 3/1966 | Goinard | 24/643 |
| 3,266,110 | 8/1966 | Davis | 24/650 X |
| 3,451,720 | 6/1939 | Makinen | 24/650 X |
| 4,136,425 | 1/1979 | Esner | 24/641 |
| 4,182,008 | 1/1980 | Pouget | 24/645 |
| 4,358,879 | 11/1982 | Magyar | 24/641 |
| 4,375,714 | 3/1983 | Korger | 24/640 |
| 4,451,958 | 6/1984 | Robben et al. | 24/636 |

*Primary Examiner*—William E. Lyddane
*Assistant Examiner*—Peter A. Aschenbrenner
*Attorney, Agent, or Firm*—Fitch, Even, Tabin & Flannery

[57] ABSTRACT

A seat belt buckle having a buckle frame and a pivotal latching member mounted therein includes a single spring for biasing a push button toward an outer position and for ejecting a tongue plate from the frame when the latch mechanism is in its open position. The preferred spring is a coil spring which is loaded in tension in an extended configuration. In the preferred embodiment, the spring additionally provides biasing force to lock the latch mechanism in its latching position after insertion of the tongue plate into the buckle frame and provide biasing force to maintain the latching member in its open position prior to insertion of the tongue plate.

15 Claims, 6 Drawing Figures

SEAT BELT BUCKLE

BACKGROUND OF THE INVENTION

The present invention relates generally to a seat belt buckle, and more particularly to a seat belt buckle suitable for use in motor vehicles.

A seat belt buckle provides a readily releasable mechanism for securing the ends of a seat belt and/or shoulder belt in a predetermined position to restrain an occupant of a vehicle during a collision.

One form of seat belt buckle in use particularly in Europe has a side operated push button rather than a top push button and employs a lock pin or latch bar which is positioned to block release of a latching dog from locking engagement with a tongue plate until the push button is operated. Usually, the lock pin or bar is mounted to slide in slots in the frame and is shifted by movement of the push button from a blocking position over the latch dog to release position in which the latch dog is free to pivot from latching engagement with the tongue plate. In such buckles, the push button is typically biased toward an outer position and is pushed inward to open the latch mechanism.

Various government and industry standards impose requirements on seat belt buckles which are to be used in motor vehicles. To comply with such standards, a seat belt buckle should be able to withstand relatively high tensile forces without deforming substantially and without releasing the tongue plate when the latching means is in its latched position. In addition, the buckle should be releasable upon the application of a reasonable amount of force to the push button even if a person is hanging upside down from the seat belt. That is, in the event of an accident where a vehicle has overturned and the weight of the driver is supported by the belt, the tension on the buckle should not make it overly difficult to open. Also, the latching means should not release accidentally due to impact or vibration, but should be releasable only by actuation of the push button.

It is further desirable that the seat belt buckle provide a clear indication to the user as to whether it is latched when the tongue plate is inserted into the buckle frame so as to avoid false latching conditions. To this end, some seat belt buckles employ ejectors which urge the tongue plate forwardly of the buckle frame to eject it therefrom if the tongue plate is within the buckle but not latched in place.

In the past, seat belt buckles of the type having a spring-biased push button in combination with an ejector have generally employed relatively complicated mechanisms which include at least two separate springs, and have commonly used coil springs loaded in compression. Use of coil springs loaded in compression may be more expensive than use of coil springs loaded in tension for analogous functions, because a coil spring loaded in compression may buckle when loaded instead of compressing along a desired line or curve, and the design constraints on compression springs may need to be more narrowly defined to prevent such buckling.

Side release buckles of the foregoing kind are produced in large numbers for use as original equipment on automobiles. Hence, savings in parts, raw material costs, and assembly of the buckles are important and may make the difference between a buckle being commercially successful or unsuccessful. In addition to costs, there is today a preference for small, lightweight buckles. Conflicting with the preference for small, lightweight buckles is the competing demand by automotive companies that buckles be capable of handling heavier loads than heretofore, e.g., 5000 lb. tensile loads.

SUMMARY OF THE INVENTION

In accordance with the present invention, a seat belt buckle is provided wherein a single spring provides force for biasing the push button toward an outer position and ejection force for urging the tongue plate forwardly of the frame when the latch mechanism is in its open position. The preferred spring is a coil spring which is loaded in tension in an extended configuration. In addition to providing ejection force and force for biasing the push button outwardly, the spring herein additionally provides force to urge the locking means toward the locked configuration upon movement of the latching means to latching position, and provides force to pull the latching means toward open position when the push button is actuated.

Accordingly, it is a general object of the present invention to provide a new and improved seat belt buckle.

It is an additional object of the present invention to provide a lightweight, high strength seat belt buckle which may be manufactured at commercially competitive costs.

Further objects and features of the present invention will become apparent from the following detailed description and the accompanying drawings.

Figure 1:
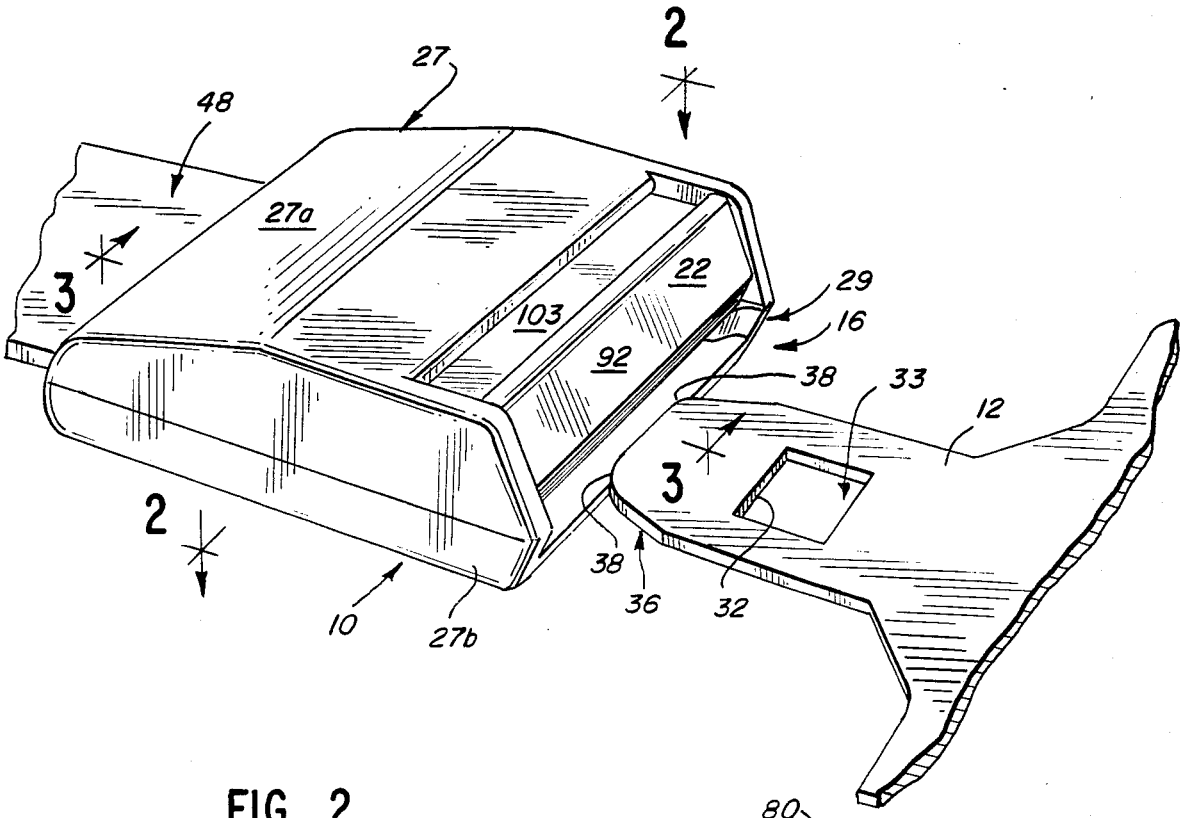
FIG. 1 is a perspective view of a seat belt buckle in accordance with the present invention.

FIG. a plan view of the interior of the buckle of FIG. 1, taken substantially along line 2—2 in FIG. 1.

Figure 3:
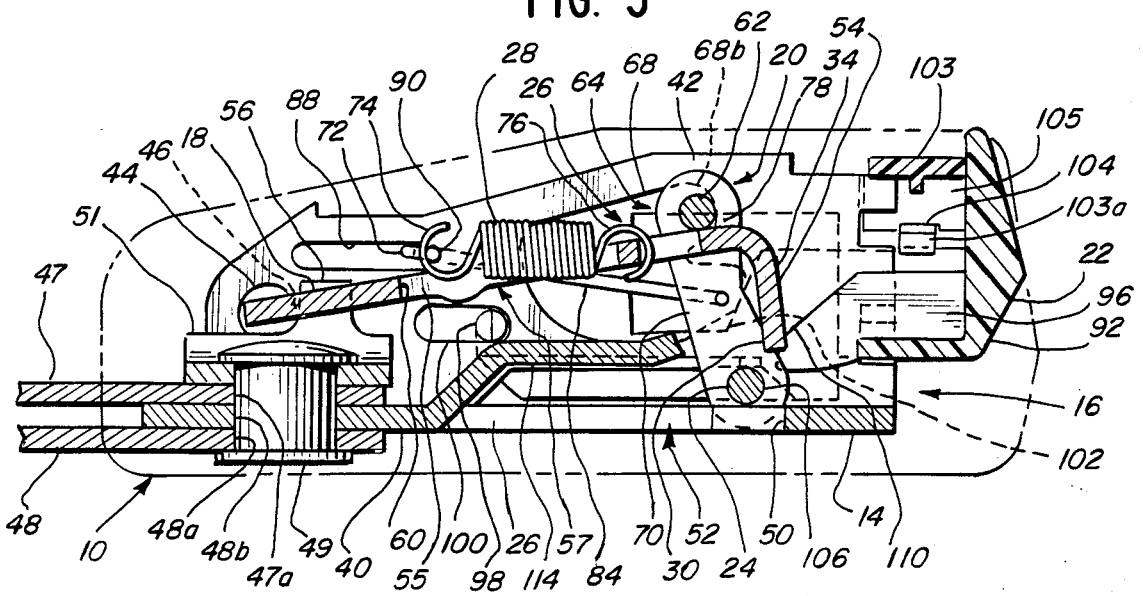

FIG. 3 is a longitudinal sectional elevational view of the buckle of FIG. 1 taken substantially along lines 3—3 in FIG. 1 and looking in the direction of the arrows.

Figure 4:
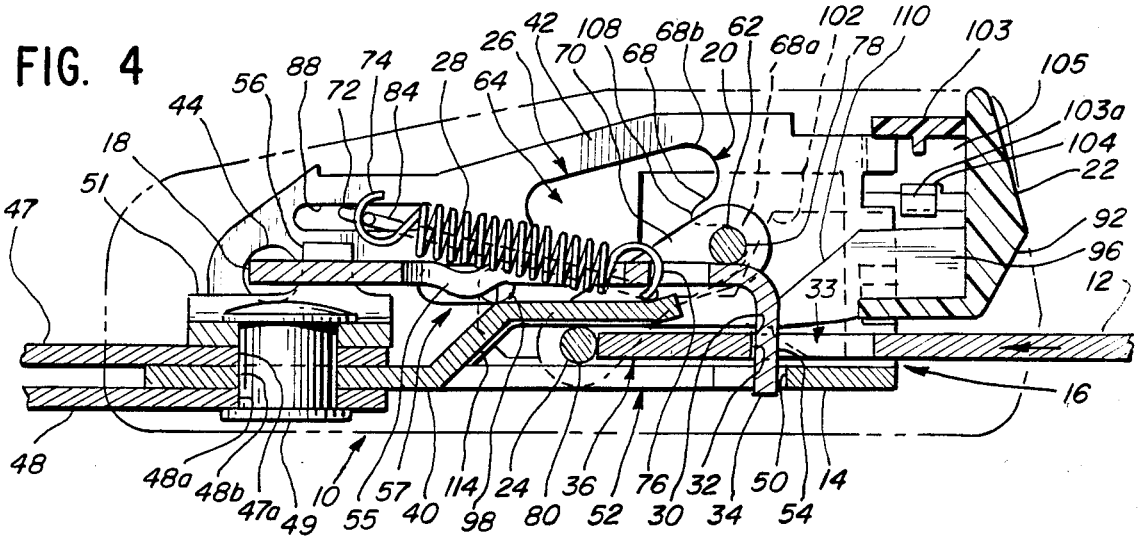

FIG. 4 is a longitudinal sectional elevational view of the buckle of FIG. 1 taken substantially along line 3—3 in FIG. 1 and looking in the direction of the arrows, but showing the tongue plate in an inserted position within the interior of the buckle frame, and showing the latching means in latching position.

FIG. is a longitudinal sectional elevational view of the buckle of FIG. 1, taken substantially along line 3—3 in FIG. 1 and looking in the direction of the arrows, but showing the buckle with the push button in an inner position, and showing the latching means in a position between latching position and open position.

Figure 6:
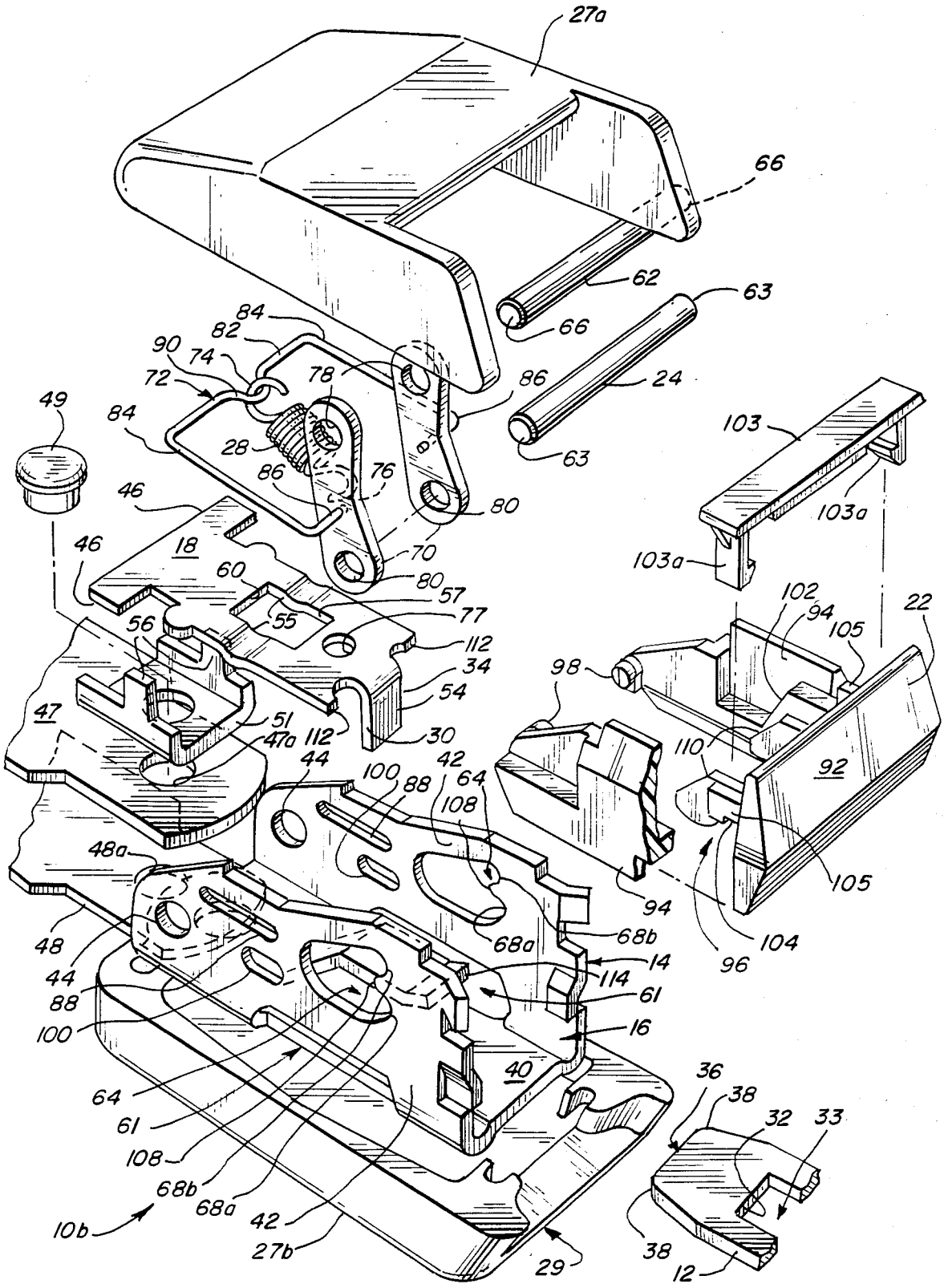

FIG. 6 is an exploded perspective view of the buckle of FIG. 1, shown with portions broken away for clarity.

DETAILED DESCRIPTION OF THE PREFERRED EMBODIMENT

In the following description, the buckle will be described in its illustrated orientation, and terms such as "upward" and "downward" will refer to directions relative to the illustrated orientation. It will be appreciated that this orientation has been selected merely for convenience of description, and that the buckle may assume any of various different orientations during use.

Figure 2:
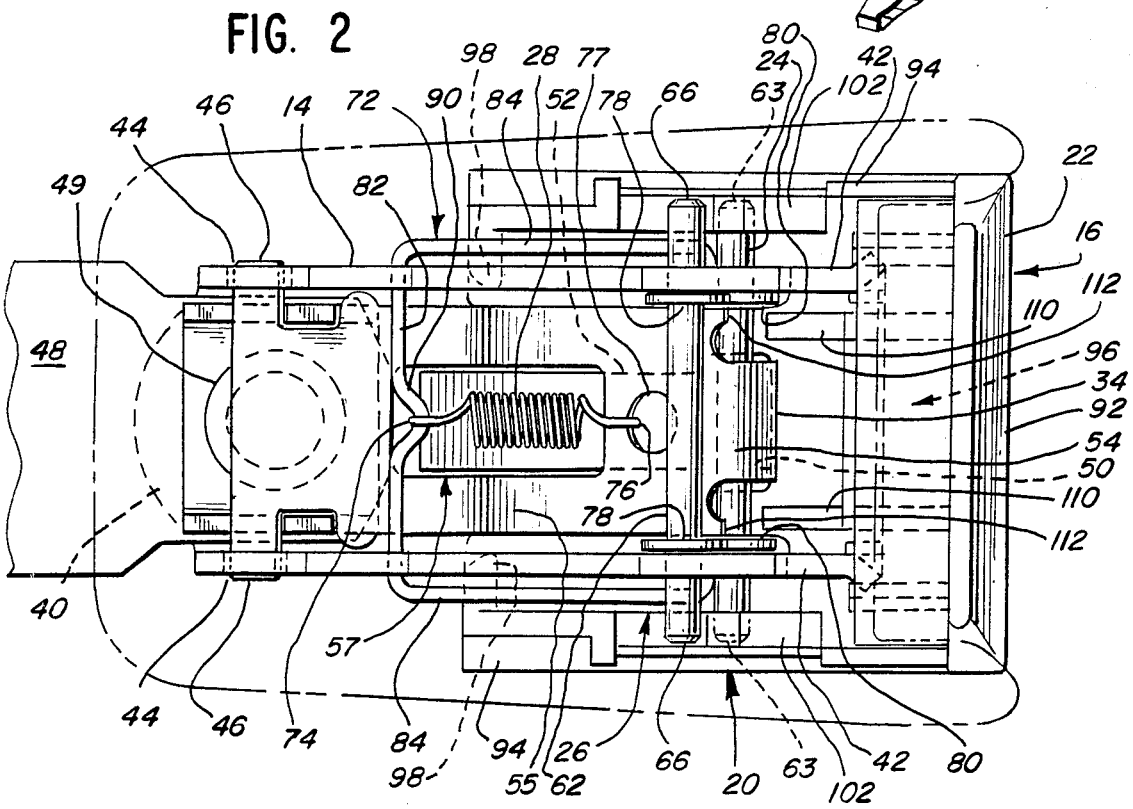

The present invention is generally embodied in a seat belt buckle 10 which includes a tongue plate 12 and a buckle frame 14 having an opening 16 at its forward end for receiving the tongue plate 12. Mounted within the buckle frame are pivotal latching means 18 movable between a latching position (FIG. 4) for retaining the tongue plate 12 within the buckle frame 14 and an open position (FIGS. 1–3) for enabling the tongue plate 12 to travel into and out of the buckle frame 14. The buckle 10 further includes locking means 20 movable between a locked position for securing the latching means 18 in latching position and an unlocked position for enabling the latching means 18 to move between latching position and open position. A push button 22 shifts the latching means 18 from latching position to open position as the push button 22 is moved from a first, or outer position to a second, or inner position. Ejection means 24 urge the tongue plate 12 forwardly of the buckle 10 when the latching means 18 shift to open position. The movements of the various components are coordinated by actuator means 26.

The illustrated buckle 10 includes an exterior cover 27 which includes a top 27*a* and a bottom 27*b*. The bottom 27*b* has a flared opening 29 at its forward end to receive the tongue plate 12.

In the past, push button actuated seat belt buckles 10 which have included ejection means have generally included at least two different springs, one to bias the push button toward an outer position, and one to provide ejection force.

In accordance with the present invention, there is provided a compact, lightweight and inexpensive buckle of the side release type which is capable of withstanding tensile loads of up to about 5000 lbs. and which remains latched under such loads with a transverse locking member or pin 62 being positioned in blocking relationship to the latching means or pawl 18 when in latching position, as best seen in FIG. 4. As will be described herein, the latching pawl 18 is configured and related to the transverse member 62 so that is capable of withstanding these heavy loads despite its relatively small size and light weight.

Also in accordance with the present invention, a single spring 28 provides force to bias the push button 22 forward toward its outer position and ejection force to urge the tongue plate 12 forwardly of the frame 14 when the latching means 18 is in open position. The preferred spring 28 is a coil spring which is maintained in tension in an extended configuration. To avoid the possibility of the tongue plate 12 being retained within the buckle frame without the latching means 18 being locked in latching position, it is desirable that the locking means 20 automatically shift to locked position after insertion of the tongue plate 12. To this end, in the preferred embodiment of the present invention, the spring 28 additionally provides force to urge the locking means 20 toward its locked configuration after insertion of the tongue plate 12.

It will be appreciated that the latching means 18 must be held in open position prior to insertion of the tongue plate 12 to enable insertion of the tongue plate 12. This is also accomplished in the illustrated embodiment by the spring 28. The spring 28 provides biasing force to maintain the latching means 18 in open position when the locking means 20 is in its unlocked position.

Turning now to a more detailed description of the illustrated embodiment of the present invention, the latching means 18 comprises a pawl 18 which is pivotal between an upper or open position (FIG. 3) and a lower or latching position (FIG. 4). To retain the tongue plate 12 within the buckle frame, the pawl 18 includes a rearwardly facing surface 30 which is moved into engagement with a forwardly facing surface 32 of the tongue plate 12 when the tongue plate is inserted into the buckle frame 14. In the illustrated embodiment, the rearwardly facing surface 30 is formed on a downwardly extending dog or tooth 34 at the forward end of the pawl 18, and the forwardly facing surface 32 is formed in an opening 33 formed generally centrally through the tongue plate 12 which receives the tooth 34 of the pawl 18. The tongue plate 12 has a tapered leading end 36 with rounded corners 38 to facilitate its insertion into the buckle frame 14.

The buckle frame 14 herein includes a bottom wall 40 and a pair of upstanding sidewalls 42. To pivotally support the pawl 18 on the buckle frame 14, openings 44 are provided near the rear end of each sidewall 42 to accommodate ears 46 extending outwardly on opposite sides of the rearward end of the pawl 18.

To secure the frame 14 of the buckle 10 to a support on the interior of a vehicle, means such as the illustrated straps 47 and 48 are provided. The straps 47 and 48 are preferably made of Martensite steel to provide a high tensile strength member to resist the high tensile loads which may break similar members of ordinary steel. Generally circular openings 47*a* and 48*a* are formed through the straps and aligned with a corresponding opening 48*b* in the bottom wall 40 of the frame 14 so that a fastener, such as the illustrated rivet 49 passing through the aligned openings 47*a*, 48*a* and 48*b*, may be employed to secure the frame 14 to the straps 47 and 48. The rivet 49 also secures in place a bracket 51 which assists in constraining the pawl 18 as explained in further detail below.

When tensile force is applied to the tongue plate 12 tending to pull it out of the interior of the buckle frame 14, as during a collision, the force is transmitted to the pawl 18, tending to pull the pawl forwardly of the buckle 10 and tending to deform the pawl. To enable the buckle 10 to withstand relatively high forces without failing, means are provided for retaining the pawl within the buckle frame 14 and supporting it against excessive deformation.

In the illustrated embodiment, the pivotal engagement of the ears 46 of the pawl in the openings 44 in the sidewalls 42 of the frame 14 provides support for the pawl 18 at its rearward end. When in its lower or latching position, the pawl 18 is further supported at its forward end by a rearwardly facing surface 50 formed at the forward end of an opening 52 in the bottom wall 40 of the frame 14. This surface 50 is normally spaced from the forward surface 54 of the pawl tooth 34 by a small distance, but when excessive tensile force is applied to the buckle 10, the pawl 18 deforms so that the forward surface 54 of the pawl tooth 34 can move into abutting engagement with the rearwardly facing surface 50 and thereby be constrained against further forward movement. Thus, this engagement both constrains the pawl 18 from moving forwardly and constrains the tooth 34 against bending forwardly and upwardly.

The deformation of the pawl 18 to enable contact between the tooth 34 and the rearwardly facing surface 50 may include both bending of the tooth and elongation of the remainder of the pawl. It is desirable that the deformation be elastic so that after application of an impact load, the pawl 18 returns to its original configuration so that the buckle continues to operate properly. To this end, the pawl has a bend 55 formed in it adjacent a generally rectangular central opening 57 which enables elastic elongation of the pawl 18 under tension. That is, the transverse bend 55 will tend to straighten under high tension loading and allow the pawl body to elongate slightly to allow the tooth surface 54 to abut the frame surface 50.

To provide additional support for the pawl 18 at its rearward end, the bracket 51 riveted to the straps 47 and 48 has a pair of upwardly extending lugs 56 which engage the outwardly extending ears 46 at the rearward end of the pawl 18. The ears 46 are normally spaced from the upwardly extending lugs 56, but when the pawl is subjected to tension, the ears 46 move into abutting relation with the lugs 56, and the lugs 56 thus cooperate with the openings 44 in the sidewalls 42 of the frame 14 and with the rearwardly facing surface 50 to constrain the pawl 18 against forward movement.

The leading end 36 of the tongue plate 12 engages the ejection means 24 as the leading end 36 is inserted into the buckle 10. The illustrated ejection means 24 is an elongated cylindrical member 24 which extends across the width of the buckle frame 14. To enable the ejection member 24 to travel longitudinally of the buckle without moving vertically, elongated openings 61 formed at the intersections of the sidewalls 42 and bottom wall 40 of the frame 14 herein receive the opposite ends 63 of the ejection member 24. Use of a simple cylindrical ejection member may provide cost savings as compared to molded sliders of relatively complicated configuration which have been employed in the past for analogous functions.

The locking means 20 herein comprises a transverse locking member or pin 62 which extends across the top of the pawl 18, and detent means 64 defining an unlocked position and a locked position for the transverse member 62. In the locked position, the detent means 64 constrain the transverse member 62 against upward movement, and the transverse member 62 constrains the pawl 18 against upward movement. The detent means 64 in the illustrated embodiment comprise a pair of openings 64, one formed through each of the sidewalls 42 of the frame 14, which engage respective opposite ends 66 of the transverse member 62. Each opening defines a curved surface 68 against which the transverse member 62 is urged. The curved surface includes two adjacent curved detents 68*a* and 68*b* for the locked and unlocked positions respectively.

To automatically shift the latching means 18 to latching position upon insertion of the tongue plate 12, the ejection member 24 is interconnected with the transverse member 62 herein by actuator means 26 which pull the transverse member 62 downwardly as the ejection member 24 is pushed rearwardly by the leading end 36 of the tongue plate 12 as the tongue plate 12 travels rearwardly into the buckle frame 14. The actuator means 26 herein include rigid link means 70 extending between the transverse member 62 and the ejection means 24, and a connector member 72 which interconnects the link means 70 and the spring 28. In the illustrated embodiment, the link means 70 include a pair of relatively rigid links 70 and the connector member 72 comprises a wire bail 72 which is pivotally joined to the links 70 and extends rearwardly from the links to the rearward end 74 of the spring 28. The forward end 76 of the spring 28 is curved into a generally hook-shaped configuration and is attached to the pawl 18 near the forward end of the pawl. To facilitate this attachment, an opening 77 (FIG. 2) is provided in the pawl 18 near its forward end to receive the forward end 76 of the spring 28.

The transverse member 62 is preferably a generally cylindrical pin 62 which fits through generally circular apertures 78 near the upper ends of the respective links. The ejection means 24 preferably extends through generally circular apertures 80 at the lower ends of the respective links 70. The connector member or bail 72 is preferably of generally rectangular shape, having a rear transverse portion 82, a pair of opposite side portions 84 extending forwardly of the rear portion, and a pair of forward transverse portions 86 extending inwardly at the forward ends of the respective side portions 84. To guide the bail 72 as it travels, guide slots 88 are formed in the sidewalls 42 of the frame 14 and the rear portion 82 of the bail 72 extends through the slots 88. The rear end 74 of the spring 28 is connected to the bail 72 at a detent 90 formed in the rear portion 82 of the bail 72.

The buckle 10 is shown in FIG. 3 with the pawl 18 in open position for receiving the tongue plate 12. In the open position, the ejection member 24 is located below and slightly forward of the transverse member 62 with its opposite ends 63 abutting respective rearward facing surfaces 106 (FIG. 3) at the bottom of the push button 22. In this position, the tension on the spring 28 acts through the bail 72 to urge the links 70 forwardly. The transverse member 62 is constrained against forward movement by the detent means 64 formed in the sidewalls 42 of the frame 14. Thus, the force exerted on the links 70 by the bail 72 tends to pivot the links 70 in a counterclockwise direction, urging the ejection member 24 forward. The engagement between the ends 63 of the ejection member and the surfaces 106 on the push button 22 transmits the spring force to the push button 22 to bias it toward its outer position.

The push button 22 herein preferably has a front wall 92 which is generally smooth and attractive for engagement by the fingers of the user, a pair of sidewalls 94 extending rearwardly therefrom, and a camming structure 96 for engagement with the buckle pawl 18 as described in further detail below. Each of the sidewalls 94 has an inwardly extending lug 98 formed on it to engage an elongated slot 100 in an adjacent sidewall 42 of the buckle frame 14. Additionally, each of the sidewalls 94 has a camming surface 102 formed on its inner surface for engaging the transverse member 62 as also described below.

The illustrated push button is of two-piece plastic construction. A top wall or cap 103 is attached behind the front wall 92 of the push button 22. The cap 103 includes a pair of integral snap fastener hooks 103A which engage downwardly facing recesses 104 on brackets 105 formed rearwardly of the front wall 92 of the push button 22.

In the position illustrated in FIG. 3, the rearward, inwardly extending lugs 98 on the push button 22 are at the forward ends of their respective associated slots 100 in the sidewalls 42 of the frame 14. Also, the rearward transverse portion 82 of the bail 72 is at or near the forward ends of the slots 88 through which it passes.

Turning now to a description of the operation of the buckle of the preferred embodiment, when the tongue plate 12 is inserted into the buckle frame 14, its leading end 36 engages the ejection member 24 and pushes the ejection member 24 rearwardly, pivoting the links 70 clockwise in opposition to the biasing provided by the spring 28. The rear portion 82 of the bail 72 travels rearwardly while guided by the slots 88 in the sidewalls 42 of the frame 12. This extends the spring 28 so that the force exerted by the spring 28 on the links 70 progressively increases. The longitudinal slots 61 in the sidewalls 42 engage the ends 63 of the ejection member 24 to prevent it from moving upwardly as it travels rearwardly, and the links maintain a fixed spatial relation between the ejection member 24 and the transverse member 62. Accordingly, as the ejection member 24 is pushed rearwardly, and the links 70 are urged forwardly by the spring force acting through the bail 72, the transverse member 62 is pulled downwardly along the curved surfaces 68 of defined by the detent means 64 formed in the sidewalls of the frame. As the transverse member 62 travels downwardly, it pushes the latching means 18 downwardly into the latching position wherein the pawl tooth 34 extends through the opening 33 in the tongue plate 12 and into the opening 52 in the bottom wall 40 of the frame 14. When the latching means 18 reaches its latching position, as shown in FIG. 4, the transverse member 62 is moved into the locking position by the force of the spring 28 transmitted through the links 70 and through the bail 72.

It will be appreciated that when the latching means 18 is in its latching position as illustrated in FIG. 4, the tongue plate 12 may not be withdrawn from the interior of the buckle frame 14 without structural failure of some component of the buckle 10.

Figure 5:
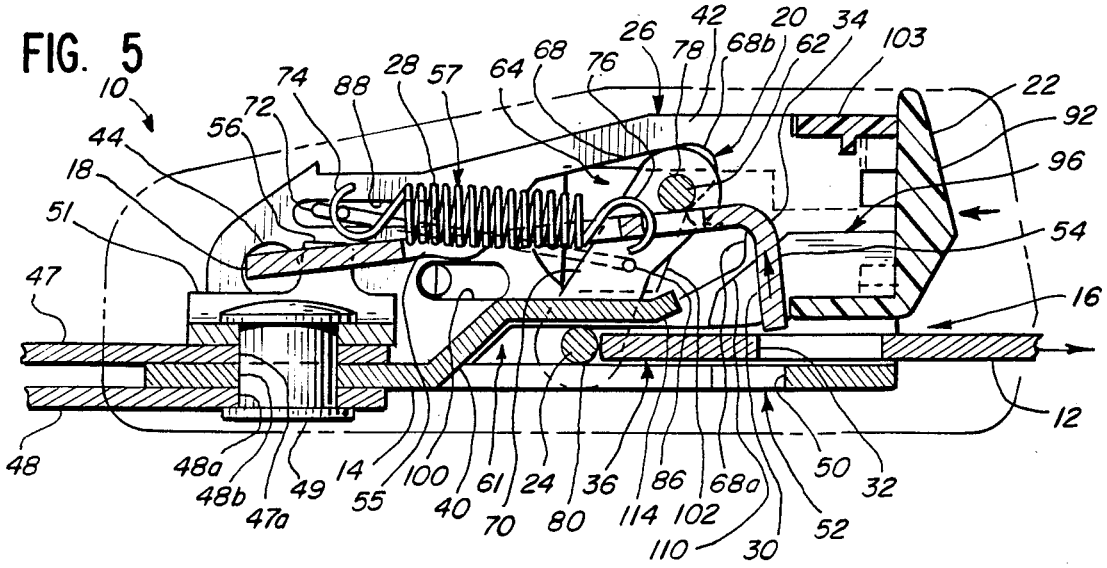

To open the latching means 18 and permit withdrawal of the tongue plate 12, the push button 22 is pushed inwardly to the position illustrated in FIG. 5. As the push button 22 travels inwardly, it displaces the transverse member 62 rearwardly to the point 108 where it is no longer constrained against upward movement by the detent means 64. This displacement is accomplished by the engagement of the camming surfaces 102 on the push button 22 with the opposite ends 66 of the transverse member 62. The camming surfaces 102 herein are inclined so as to urge the transverse member 62 upwardly as well as rearwardly. Under conditions of low tension or no tension on the buckle 10, once the transverse member 62 reaches this point 108, the spring force pulls the latching means 18 to open position.

If there is a considerable amount of tension on the buckle 10, the spring force alone may be insufficient to pull the latching means 18 to open position upon the transverse member 62 reaching this point 108. Accordingly, camming means 96 are provided on the push button to enable the latching means 18 to be shifted from latching position to open position by manual effort. In the illustrated embodiment, the push button camming structure 96 has a pair of camming surfaces 110 formed on it which engage shoulders 112 on the latching means 18 to push it upwardly as the push button 22 is pushed inwardly. Once the transverse member 62 has traveled upward beyond the point 108, it is urged by the spring force into the detent **68*b*** corresponding to the unlocked position.

As the latching means 18 is lifted, it is desirable that the tongue plate be prevented from moving vertically upward. Herein, this is accomplished by a retaining finger 114 which is integrally formed with the frame 14. This enables the latching means 18 to be "stripped" from the tongue plate 12. Once the latching means 18 is in open position, the tongue plate 12 is free to move forwardly, out of the buckle frame 14. To urge the tongue plate 12 in this direction, the ejection member 24 engages the leading end 36 of the tongue plate 12 as shown in FIG. 5. As the ejection member 24 travels forwardly, its ends engage the surfaces 106 on the push button 22 to return the push button 22 to its outer position, returning the buckle 10 to the configuration illustrated in FIG. 3.

From the foregoing, it will be appreciated that the present invention provide a novel and improved seat belt buckle which employs a single spring to form a plurality of different functions in the operation of the buckle. While a preferred embodiment 10 of the invention has been illustrated and described above, there is no intent to limit the scope of the invention to this or any other specific embodiment. The scope of the invention is defined by the spirit and language of the appended claims.

What is claimed is:

1. A seat belt buckle comprising: a tongue plate; a buckle frame having an opening at its forward end for receiving the tongue plate; pivotal latching means movable between a latching position for retaining the tongue plate within the buckle frame and an open position for enabling the tongue plate to travel into and out of the buckle frame; locking means movable between a locked configuration for locking the latching means in its latching position and an unlocked configuration for enabling the latching means to move between its latching position and its open position; ejection means for engaging end of the tongue plate and being moved rearwardly with insertion of the tongue plate, a push button movable between a first position and a second position and operatively associated with the latching means to shift the latching means from latching position to open position when the pushbutton is moved from its first postion to its second position; and a single tensile spring which provides biasing force to bias the push button toward its first position and ejection force for the ejection means to urge the tongue plate forwardly of the buckle frame upon movement of latching means from latching position to open position said tensile spring having a forward end connected to the latch means to pull the latch means to its open position, a linkage means connected between the ejector means and the locking means, and a rearward end of the tensile spring connected to linkage means to pull it and the locking means forwardly to shift the locking means into locking position upon release of the tongue plate by the wearer.

2. A seat belt buckle in accordance with claim 1 wherein the spring further provides biasing force to the locking means toward the unlocked configuration when the latching means is in open position.

3. A seat belt buckle comprising: a tongue plate; a buckle frame having an opening at its forward end for receiving the tongue plate; pivotal latching means movable between a latching position for retaining the tongue plate within the buckle frame and an open position for enabling the tongue plate to travel into and out of the buckle frame; locking means for locking the latching means in latching position comprising a movable transverse member extending across the width of the buckle adjacent the latching means and detent means defining a locked position and an unlocked position for the transverse member; a push button movable between a first position and a second position and operatively associated with the latching means for shifting the latching means from latching position to open position when the push button is moved from the first position to the second position; ejection means for engaging the leading end of the tongue plate; actuating means operatively associating the ejection means with the transverse member to shift the latching means into latching position upon insertion of the tongue plate; and biasing means to bias the transverse member toward the unlocked position when the latching means is in open position and urge the transverse member into locked position when the tongue plate is pushed into the buckle frame and the latching means is moved into latching position; the biasing means comprising a coil spring loaded in tension, said coil spring having a forward end connected to the latching means to bias the latching means to its open position and a rearward end connected to the actuating means for being extended by the ejection means upon insertion of the tongue plate and shifting said transverse member to the locked position upon release of the tongue plate by the wearer.

4. A seat belt buckle in accordance with claim 3 wherein the buckle frame includes an integral retaining finger which extends over the tongue plate when the tongue plate is within the buckle frame to prevent upward movement of the tongue plate relative to the buckle frame.

5. A seat belt buckle in accordance with claim 3 wherein the ejection means comprises a generally cylindrical pin extending transversely across the width of the buckle.

6. A seat belt buckle in accordance with claim 3 wherein the push button includes first camming means for displacing the transverse member from the locked position as the push button is moved from its first position to its second position, and second camming means for pivoting the latching means to open position when the push button is moved from its first position to its second position.

7. In a seat belt buckle the combination comprising: a tongue plate; a buckle frame means having an opening at its forward end for receiving a tongue plate; a latch lever having an elongated body pivotally mounted in the buckle frame and moveable between a latching position for latching the tongue plate to the buckle frame means and a release position enabling the tongue plate to be separated from the buckle frame means; a push button depressable to actuate the latching lever to its release position; biasing means for biasing the push button and for biasing the latch lever into its latching position; a dog on one end of the latch lever for latching engagement with the tongue plate; said tongue plate and buckle frame means adapted to be received in the latching position and receiving a tensile force attempting to pull the tongue plate from the dog; a deflectable portion on the body of the latch lever for stretching in the direction of tensile force being applied to the dog by the tongue plate; and stop means associated with the buckle frame normally spaced from the latch lever and abutted by the latch lever when it is stretched to assist in holding the tongue plate under high tensile forces applied thereto.

8. A buckle in accordance with claim 7 in which the deflectable portion includes a band curved in a direction transverse to the longitudinal length of the elongated body.

9. A buckle in accordance with claim 7 in which abutment means are provided on the buckle for movement into engagement with a portion of the latch lever when the latch lever is under high tension loading.

10. A buckle in accordance with claim 7 including a pair of elongated straps of martensite steel are connected to the rearward end of the buckle frame means.

11. A seat belt buckle in accordance with claim 10 including bracket means for attaching the martensite steel straps to the buckle frame means; and abutment means on the bracket means for abutting portions of the latch lever when the latch lever is highly loaded to assist in transfering load to the straps from the latch lever.

12. In a seat belt buckle the combination comprising:

a tongue plate;

a buckle frame having an opening at its forward end for receiving a tongue plate;

a latch lever pivotally mounted in the buckle frame and moveable between a latching position for latching the tongue plate to the buckle frame and a release position enabling the tongue plate to be separated from the buckle frame;

a pushbutton depressable to actuate the latching lever to its release position;

biasing means for biasing the pushbutton and for biasing the latching means into its latching position;

a pair of elongated straps of martensite steel connected to the rearward end of the buckle frame; bracket means for attaching the martensite steel straps to the buckle frame means; and abutment means on the bracket means for abutting portions of the latch lever when the latch lever is highly loaded to assist in transfering load to the straps from the latch lever.

13. A seat belt buckle comprising: a tongue plate; a buckle frame having an opening at its forward end for receiving the tongue plate; pivotal latching means movable between a latching position for retaining the tongue plate within the buckle frame and an open position for enabling the tongue plate to travel into and out of the buckle frame; locking means for locking the latching means in latching position comprising a movable transverse member extending across the width of the buckle adjacent the latching means and detent means defining a locked position and an unlocked position for the transverse member; a push button movable between a first position and a second position and operatively associated with the latching means for shifting the latching means from latching position to open position when the push button is moved from the first position to the second position; ejection means for engaging the leading end of the tongue plate; actuating means operatively associating the ejection means with the transverse member to shift the latching means into latching position upon insertion of the tongue plate; and biasing mean to bias the transverse member toward the unlocked position when the latching means is in open position and urge the transverse member into locked position when the tongue plate is pushed into the buckle frame and the latching means is moved into latching position; the biasing means comprising a coil spring loaded in tension, said spring having forward and rearward ends, the spring being attached at its forward end to the latching means to urge the latching means toward open position, said ejection means comprising a generally cylindrical pin extending transversely across the width of the buckle, said actuating means comprising a pair of relatively rigid links fastened to respective opposite ends of the transverse member and the ejection means, and a bail interconnecting the links with the rearward end of the spring.

14. A seat belt buckle comprising: a tongue plate; a buckle frame having an opening at its forward end for receiving the tongue plate; pivotal latching means movable between a latching position for retaining the tongue plate within the buckle frame and an open position for enabling the tongue plate to travel into and out of the buckle frame; locking means for locking the latching means in latching position comprising a movable transverse member extending across the width of the buckle adjacent the latching means and detent means defining a locked position and an unlocked position for the transverse member; a push button movable between a first position and a second position and operatively associated with the latching means for shifting the latching means from latching position to open position when the push button is moved from the first position to the second position; ejection means for engaging the leading end of the tongue plate; actuating means operatively associating the ejection means with the transverse member to shift the latching means into latching position upon insertion of the tongue plate; and biasing means to bias the transverse member toward the unlocked position when the latching means is in open position and urge the transverse member into locked position when the tongue plate is pushed into the buckle frame and the latching means is moved into latching position; the biasing means comprising a coil spring loaded in tension; said pivotal latching means having a support means at its rearward end for engaging the buckle frame to constrain the latching means against forward movement and tongue engagement means at its forward end for preventing forward movement of the tongue plate when the latching means is in latching position, the latching means having a bend formed in it between the support means and the tongue engaging means to enable slight elongation of the latching means under tension.

15. A seat belt buckle in accordance with claim 14 wherein the buckle frame has an opening formed in it to receive the tongue engaging means to limit forward travel thereof when the latching means is in latching position.

* * * * *

UNITED STATES PATENT AND TRADEMARK OFFICE

CERTIFICATE OF CORRECTION

PATENT NO. : 4,562,625

DATED : January 7, 1986

INVENTOR(S) : GERALD A. DOTY and WILLIAM E. HUNTER, Jr.

It is certified that error appears in the above-identified patent and that said Letters Patent is hereby corrected as shown below:

Column 2, line 34 after "FIG." (first occurrence) insert --2 is--.

Column 2, line 46 after "FIG." insert --5--.

Column 8, line 25 after "engaging" insert --the leading--.

Column 8, line 36 after "position" (second occurrence) insert --,-- (comma).

Signed and Sealed this

*Twenty-fifth* Day of *March 1986*

[SEAL]

*Attest:*

DONALD J. QUIGG

*Attesting Officer*

*Commissioner of Patents and Trademarks*